US008511172B2

(12) United States Patent
Smith

(10) Patent No.: US 8,511,172 B2
(45) Date of Patent: Aug. 20, 2013

(54) SHEET METAL STRETCH-BEND-DRAW SIMULATOR APPARATUS AND METHOD

(75) Inventor: Lorenzo Marco Smith, Shelby Township, MI (US)

(73) Assignee: Oakland University, Rochester, MI (US)

( * ) Notice: Subject to any disclaimer, the term of this patent is extended or adjusted under 35 U.S.C. 154(b) by 355 days.

(21) Appl. No.: 12/931,200

(22) Filed: Jan. 26, 2011

(65) Prior Publication Data

US 2011/0271775 A1 Nov. 10, 2011

Related U.S. Application Data

(60) Provisional application No. 61/336,753, filed on Jan. 26, 2010.

(51) Int. Cl.
*G01B 5/30* (2006.01)

(52) U.S. Cl.
USPC ..... 73/760; 73/831

(58) Field of Classification Search
USPC ..... 73/760, 831, 862.393
See application file for complete search history.

(56) References Cited

U.S. PATENT DOCUMENTS 3,926,247 A * 12/1975 Geiger et al. ..... 164/263
4,489,584 A * 12/1984 Gall et al. ..... 72/327
6,856,922 B1 * 2/2005 Austin et al. ..... 702/63
8,356,996 B2 * 1/2013 Mayrhofer ..... 434/55
2005/0241106 A1 * 11/2005 Sosa et al. ..... 16/278

* cited by examiner

*Primary Examiner* — Max Noori
(74) *Attorney, Agent, or Firm* — Butzel Long

(57) ABSTRACT

A stretch-bend-draw simulator (SBDS) apparatus for approximating die stamping of a metal is disclosed. The simulator includes a tool having a surface for contacting a sheet metal strip clamped in a jaw grip adapted to pull the sheet metal strip to provide a force measurement. A tool holding and moving device can be included for mounting, translating, and positioning the tool with respect to the sheet metal strip. The tool can be mounted on the tool holding device at a distal end or on a mounting plate of the apparatus. The tool holding device is coupled to a contact force measuring load cell for measuring the contact force. A draw bead block holder is provided that is adapted to mount a corresponding male and female draw bead blocks. The holder includes a compressing means for compressing the draw bead blocks together to clamp the strip. A clamping force measuring load cell is provided for measuring a clamping force resulting from the draw bead blocks clamping on the sheet metal strip. The simulator can include a base clamping device for mounting the sheet metal strip at an opposite end. The base clamping device is positioned adjacent the draw bead block holder and coupled to a back force measuring means for measuring a back force resulting from holding the sheet metal strip while the jaw grip pulls the sheet metal strip. The apparatus is adapted to analyze skid lines on the sheet metal strip resulting from contact with the tool.

30 Claims, 7 Drawing Sheets

SHEET METAL STRETCH-BEND-DRAW SIMULATOR APPARATUS AND METHOD

CROSS-REFERENCE TO RELATED APPLICATION

Priority is claimed to U.S. Provisional Application No. 61/336,753, filed Jan. 26, 2010, the disclosure of which is incorporated herein in its entirety.

BACKGROUND OF THE DISCLOSURE

1. Field of the Disclosure

The disclosure relates to a stretch-bend-draw bead simulator (SBDS) apparatus as well as components and methods associated therewith. The SBDS simulator can be used to experimentally evaluate pulling and holding forces of a proposed draw bead design/geometry before the proposed draw bead design is implemented in a continuous manufacturing process. Moreover, the formation of skid lines and the associated forces that cause them can be studied.

2. Brief Description of Related Technology

Sheet metal products created through the use of stamping dies sometimes feature undesirable surface distortions near regions at which the sheet metal is pulled over a tool radius. The surface distortions resulting from the pulling of the metal specimen over the tool, often referred to as "skid lines" have little significant impact on the function of the sheet metal part, but are often harmful to the manufacturer from a quality perception perspective. Currently, there exists no full, comprehensive understanding of the mechanisms which lead to surface distortions in sheet metal. Therefore, engineers have resorted to trial-and-error methods for resolving surface distortion problems during stamping die development.

OBJECTS

The objective of the present disclosure is to provide an experimental approach for obtaining force measurements associated with pulling of sheet metal strips over a rigid tool and further understanding the mechanisms triggering surface distortions in sheet metal products.

SUMMARY

The disclosure relates to stretch bend draw simulator (SBDS) apparatus for approximating die stamping of a metal. The apparatus generally includes: (a) a fixed base defining a longitudinal direction; (b) a mounting plate mounted to the fixed base; (c) a sheet metal drawing tool (e.g., cylindrical or rectangular shape) mounted to the mounting plate (e.g., fixedly mounted thereto), the sheet metal drawing tool having a surface for contacting a sheet metal strip when the sheet metal strip is pulled across the sheet metal drawing tool surface to provide a pulling force measurement; and (d) a draw bead block holder mounted to the mounting plate and adapted to mount a male draw bead block and a corresponding female draw bead block, wherein: (i) the draw bead block holder comprises (A) a compressing means (e.g., threaded shaft or screw press) for compressing the male and female draw bead blocks together to clamp the sheet metal strip therebetween when present, and (B) a clamping force measuring means (e.g., a load cell) for measuring a clamping force resulting from the male and female draw bead blocks clamping on the sheet metal strip when present; (ii) the draw bead block holder defines a back force direction for the sheet metal strip being clamped by the male and female draw bead blocks when present; and (iii) the draw bead block holder is positionable at a plurality of locations relative to the fixed base so that an angle θ between the longitudinal direction of the fixed base and the back force direction of the draw bead block holder can be selected to have a plurality of values (e.g., a selected value spanning 180° or ranging from −90° to +90°).

Various embodiments of the SBDS apparatus are possible. For example, the mounting plate is rotatably mounted to the fixed base so that a rotation of the mounting plate relative to the fixed base defines a desired angle θ between the longitudinal direction and the back force direction. In this case, the draw bead block holder can be fixedly mounted to the mounting plate. Additionally, the mounting plate can include one or more translation tracks and the draw bead block holder can be translatably mounted on the translation tracks so that the draw bead block holder is translatable in the back force direction to a plurality of positions on the mounting plate. In another embodiment, the mounting plate is fixedly mounted to the fixed base, and the draw bead block holder is mountable in a plurality of positions on the mounting plate, each position defining a desired angle θ between the longitudinal direction and the back force direction (e.g., the mounting plate comprises a mounting means positioned along an arc and adapted to mount the draw bead block holder at a desired position, thereby defining the desired angle θ between the longitudinal direction and the back force direction). In another embodiment, the apparatus further comprises a tool holding and moving means for removably mounting, translating, and positioning the tool with respect to the sheet metal strip; wherein: (i) the sheet metal drawing tool is mounted to the mounting plate via the tool holding and moving means for removably mounting, translating, and positioning the tool with respect to the sheet metal strip, (ii) the sheet metal drawing tool is removably mounted on the tool holding and moving means at a distal end and the tool holding and moving means is positionable from a proximal end, and (iii) the tool holding and moving means is coupled to a contact force measuring means (e.g., load cell) for measuring the contact force on the sheet metal strip with the surface of the tool. In such a case, the holding and moving means can be adapted to (i) translate the sheet metal drawing tool with respect to the sheet metal strip along a translation axis defined by the holding and moving means, and (ii) position the sheet metal drawing tool by moving the holding and moving means about a rotation axis. The tool holding and moving means can comprise a threaded shaft defining a longitudinal shaft axis, the threaded shaft being adapted to translate the tool along the longitudinal shaft axis. In another embodiment, the apparatus further comprises a base clamping means for mounting the sheet metal strip at an opposite end from the pulling end of the sheet metal strip, wherein the base clamping means is positioned adjacent the draw bead block holder and coupled to a back force measuring means (e.g., load cell) for measuring a back force resulting from holding the sheet metal strip when pulling the sheet metal strip across the sheet metal drawing tool surface. The apparatus can further comprise a male draw bead block and a corresponding female draw bead block housed within the draw bead block holder, wherein a gap or interface between adjacent surfaces of the male and female draw bead blocks defines a direction corresponding to the back force direction.

The SBDS apparatus can be included in a simulator system for approximating die stamping of a metal. The system generally includes (a) a stretch bend draw simulator apparatus according to any of its various disclosed embodiments; (b) a clamping and pulling means for securing one end of a sheet metal strip and for pulling the sheet metal strip across the sheet metal drawing tool surface of the apparatus, the clamping and pulling means having a pulling direction that defines the longitudinal direction of the fixed base; (c) optionally a pulling force measuring means for measuring a pulling force resulting from clamping and pulling the sheet metal strip across the sheet metal drawing tool surface of the apparatus; and (d) optionally a computer for obtaining and recording force data, wherein the clamping force measuring means and the pulling force measuring means are electronically coupled to the computer to transmit measured force data. In an embodiment, (i) the stretch bend draw simulator apparatus is mounted to a tensile strength measuring apparatus comprising a jaw grip and a load cell coupled to the jaw grip; (ii) the clamping and pulling means of the system comprises the jaw grip of the tensile strength measuring apparatus; and (iii) the pulling force measuring means is present and comprises the load cell of the tensile strength measuring apparatus.

The disclosure also relates to a method for simulating and measuring stretch bend draw characteristics. The method comprises: (a) providing the stretch bend draw simulator apparatus or system according to any of the various disclosed embodiments; (b) providing a male draw bead block and a corresponding female draw bead block housed within the draw bead block holder, wherein a gap or interface between adjacent surfaces of the male and female draw bead blocks defines a direction corresponding to the back force direction; (c) providing a sheet metal strip (e.g., steel, aluminum, or aluminum alloy) having first and second opposed ends; (d) clamping the sheet metal strip into the draw bead block holder between the male and female draw bead blocks at a position proximate the second end of the sheet metal strip; (e) contacting the sheet metal strip against the sheet metal drawing tool surface at a point intermediate the first and second ends of the sheet metal strip; (f) positioning the draw bead block holder at a location relative to the fixed base to select a desired angle θ between the longitudinal direction and the back force direction (e.g., wherein the longitudinal direction and the back force direction are different); and (g) pulling the sheet metal strip in the longitudinal direction across the sheet metal drawing tool surface of the apparatus from a point proximate the first end of the sheet metal strip. Pulling the sheet metal strip in part (g) can comprise securing the first end of the sheet metal strip in a clamping and pulling means and then pulling the sheet metal strip in the longitudinal direction with the clamping and pulling means. The method can further include measuring and optionally electronically communicating to a computer at least one of (i) a clamping force resulting from the male and female draw bead blocks clamping on the sheet metal strip and (ii) a pulling force resulting from clamping and pulling the sheet metal strip across the sheet metal drawing tool surface of the apparatus while pulling the sheet metal strip. Additionally or alternatively, the method can further include examining the pulled sheet metal strip for surface distortions resulting from the pulling of the across the sheet metal drawing tool surface. The method can further comprise repeating the method steps at two or more different angles θ between the longitudinal direction and the back force direction to identify an optimum angle or range of angles that reduces or eliminates surface distortions on the sheet metal strip for a selected sheet metal strip and sheet metal drawing tool.

In a particular embodiment, the SDBS apparatus comprises: (a) a tool having a surface for contacting a sheet metal strip when the sheet metal strip is clamped in a jaw grip adapted to clamp and pull one end of the sheet metal strip to provide a pulling force measurement; (b) a tool holding and moving means for removably mounting, translating, and positioning the tool with respect to the sheet metal strip, wherein (i) the tool is removably mounted on the tool holding and moving means at a distal end and the tool holding and moving means is positionable from a proximal end, and (ii) the tool holding and moving means is coupled to a contact force measuring means for measuring the contact force on the sheet metal strip with the surface of the tool; (c) a draw bead block holder adapted to mount a corresponding male draw bead block and a female draw bead block, the draw bead block holder comprising a corn pressing means for compressing the male and female draw bead blocks together to clamp the sheet metal strip and a clamping force measuring means for measuring a clamping force resulting from the male and female draw bead blocks clamping on the sheet metal strip; and (d) a base clamping means for mounting the sheet metal strip at an opposite end from the one end of the sheet metal strip, wherein the base clamping means is positioned adjacent the draw bead block holder and coupled to a back force measuring means for measuring a back force resulting from holding the sheet metal strip while the jaw grip pulls the sheet metal strip. The apparatus is adapted to analyze skid marks on the sheet metal strip resulting from contact with the tool. In an exemplary embodiment, the holding and moving means is adapted to (i) translate the tool with respect to the sheet metal strip along a translation axis defined by the holding and moving means and (ii) position the tool by moving the holding and moving means about a rotation axis. In a further exemplary embodiment, the tool holding and moving means comprises a threaded shaft defining a longitudinal axis, the shaft being adapted to translate the tool along the longitudinal axis. In yet a further exemplary embodiment, the jaw grip is coupled to a pulling force measuring means for measuring the pulling force of the jaw grip on the sheet metal strip.

The pulling force measuring means can be a tensile strength measuring apparatus coupled to a pulling force load cell. The contact force measuring means can be a contact force load cell. The clamping force measuring means can be a clamping force load cell. The back force measuring means can be a back force load cell. In a particular embodiment according to the present disclosure, each load cell is coupled to a computer for obtaining force data. The draw bead block holder is typically mounted on a mounting panel. The mounting panel is typically rotatable about a rotation point and rotates along a rotation axis. In an exemplary embodiment, the mounting panel comprises a pair of translation tracks and the draw bead block holder is translatably mounted on the translation tracks. In a further exemplary embodiment, the present disclosure provides for a simulator apparatus further comprising a translation force means for translating the draw bead block holder along a translation axis defined by tracks, wherein the translation force means is mounted on the base clamping means. The translation force means can be a threaded shaft. The compression means can also be a threaded shaft. In a particular embodiment of the present disclosure, tool defines a cylindrical or rectangular surface.

The present disclosure provides for a stretch bend draw simulator system for approximating die stamping of a metal. The system comprises: (a) a jaw grip for clamping and pulling one end of a sheet metal strip, wherein the jaw grip is coupled to a pulling force measuring means adapted to measure a pulling force resulting from the clamping of the jaw grip on the sheet metal strip; (b) a tool having a surface positioned adjacent the jaw grip to allow the sheet metal strip to contact the surface of the tool when clamped in the jaw grip, wherein the tool is (i) removably mounted in a holding and moving means for translating and/or positioning the tool with respect to the sheet metal strip, and (ii) coupled to a tool contact force measuring means adapted to measure a contact force resulting from the sheet metal strip contacting the surface of the tool; (c) a draw bead block holder mounted on a rotatable mounting panel, the draw bead block set adapted to mount a corresponding male draw bead block and a female draw bead block, the draw bead block set comprising a comprising a compressing means for compressing the male and female draw bead blocks together to clamp a sheet metal strip and a clamping force measuring means for measuring a clamping force resulting from the male and female draw bead blocks clamping on the sheet metal strip; and (d) a base clamping means for mounting the sheet metal strip at an opposite end from the one end of the sheet metal strip positioned adjacent the draw bead block set and coupled to a back force measuring means for measuring a back force resulting from holding the sheet metal strip while the jaw grip pulls the sheet metal strip. The apparatus is adapted to analyze skid marks on the sheet metal strip resulting from contact with the tool.

The present disclosure provides for a method for simulating and measuring stretch bend draw characteristics comprising the steps of: (a) clamping one end of a sheet metal strip in a jaw grip coupled to a pulling force measuring means for measuring the pulling force of the jaw grip; (b) contacting the sheet metal strip against a surface of a tool positioned adjacent the jaw grip to allow the sheet metal strip to contact the surface of the tool when clamped in the jaw grip, wherein the tool is (i) removably mounted in a holding and moving means for translating and/or positioning the tool with respect to the sheet metal strip, and (ii) coupled to a tool contact force measuring means for measuring a contact force resulting from the sheet metal strip contacting the surface of the tool; (c) clamping the sheet metal strip into a draw bead block holder comprised of a male draw bead block and a female draw bead block, wherein the draw bead block holder comprises a compressing means for compressing the male draw bead block with the female draw bead block and is clamping force measuring means adapted to measure a clamping force resulting from the male and female draw bead blocks clamping on the sheet metal strip; (d) mounting the sheet metal strip in a base clamping means for mounting the sheet metal strip at an opposite end from the one end of the sheet metal strip, wherein the base clamping means is positioned adjacent the draw bead block holder and coupled to a back force measuring means adapted to measure a back force resulting from holding the sheet metal strip while the jaw grip pulls the sheet metal strip; and (e) pulling the sheet metal with the jaw grip. In a particular embodiment, the method further comprises the steps of measuring (i) the pulling force of the jaw grip using the pulling force measuring means, (ii) the contact force resulting from the sheet metal strip contacting the surface of the tool using the contact force measuring means, (iii) the clamping force of the draw bead block holder using the clamping force measuring means, and (iv) the back force resulting from the holding of the sheet metal strip while the jaw grip pulls the sheet metal strip by using the back force measuring means. The measurements obtained from the force measuring means are communicated and stored in a computer coupled to the measuring means.

All patents, patent applications, government publications, government regulations, and literature references cited in this specification are hereby incorporated herein by reference in their entirety. In case of conflict, the present description, including definitions, will control.

Additional features of the disclosure may become apparent to those skilled in the art from a review of the following detailed description, taken in conjunction with the drawings, examples, and appended claims.

BRIEF DESCRIPTION OF THE DRAWINGS

For a more complete understanding of the disclosure, reference should be made to the following detailed description and accompanying drawings wherein.

Figure 1:
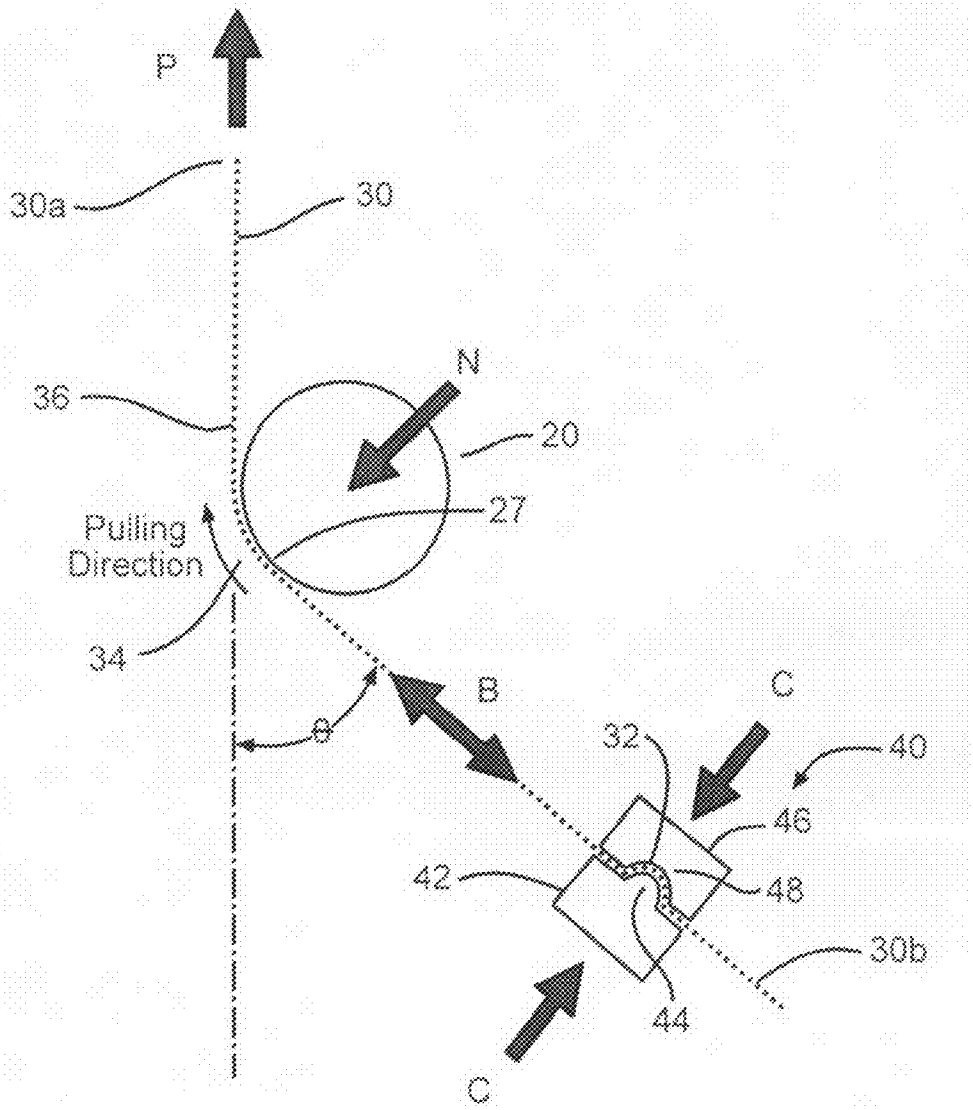
FIG. 1 illustrates a sheet metal specimen pulled vertically over a round tool surface and clamping in a draw bead block set.

While the disclosed apparatus and methods are susceptible of embodiments in various forms, specific embodiments of the disclosure are illustrated in the drawings (and will hereafter be described) with the understanding that the disclosure is intended to be illustrative, and is not intended to limit the claims to the specific embodiments described and illustrated herein.

DETAILED DESCRIPTION

The disclosed stretch-bead-draw simulator (SBDS) apparatus, associated components, and associated methods are modeled and experimentally characterized as follows.

The present disclosure provides for an apparatus for measuring directly various in-plane and contact normal forces acting upon a sheet metal specimen during a stretch-bead-draw process. A SBDS 100, 200, as shown in various embodiments illustrated in FIGS. 3-6, is operable to be integrated into a standard laboratory tensile testing machine which is commercially available. This makes measuring particular force data possible for researchers. FIG. 1 illustrates an exemplary sheet metal specimen 30 (e.g., formed from a metal such as steel, aluminum, and aluminum alloy) pulled vertically over a rounded surface 27 of a sheet metal drawing tool 20. Resistance to the pulling motion is derived through clamping action from a draw bead block set 40. As the strip of sheet metal 30 shown in FIG. 1 is pulled over a round tool 20 radius, the SBDS is capable of collecting at least some of the pulling force P, the back force B, the tool normal force N, and the corresponding draw bead clamping force C data associated with the pulling process. It is desirable to obtain real time measurements of the pulling force P, the normal force N, the back force B, and/or the clamping force C.

Analysis of the force data in conjunction with visual and tactile observations of the actual pulled specimens allows researchers to ascertain the conditions under which certain surface defects arise. The SBDS is a useful electro-mechanical laboratory device for improving researchers' knowledge of the physical phenomena associated with surface distortion effects in sheet metal products created in stamping dies.

FIG. 1 shows the exemplary sheet metal strip 30 in dotted lines being pulled vertically over the tool 20 having a generally rounded surface 27. The sheet metal strip 30 is clamped at an angle θ (or wrap angle) to the vertical pulling axis by a draw bead block set 40. As shown, the intersection of a longitudinal or pulling direction (line) corresponding to that of the pulling force P and a back force direction (line) corresponding to the back force B defines the angle θ, which is 0° when the two directions are parallel. The angle θ similarly corresponds to the curvature of the sheet metal strip 30 after it has been pulled through the SBDS. The draw bead block set 40 comprises a male block 42 and a female block 46 that cooperate to form the clamping force C on the metal sheet 30 simulating a production die set. The female block 46 defines an indent/recess 48 on its outer surface that is sized and shaped to receive a protruding boss/draw bead 44 extending from the outer surface of the male block 42. The blocks 42 and 46 are mated together with the metal sheet 30 sandwiched and deformed therebetween to form the clamping force C and secure the metal sheet 30 in place. Accordingly, when the sheet is pulled in a vertical or other pulling direction, at least four forces exist. It is desirable to measure these forces simultaneously. The forces, as shown in FIG. 1 include the pulling force P, the normal or contact force N resulting from the contact with the rounded tool 20, the back force B, and the clamping force C.

Figure 2:
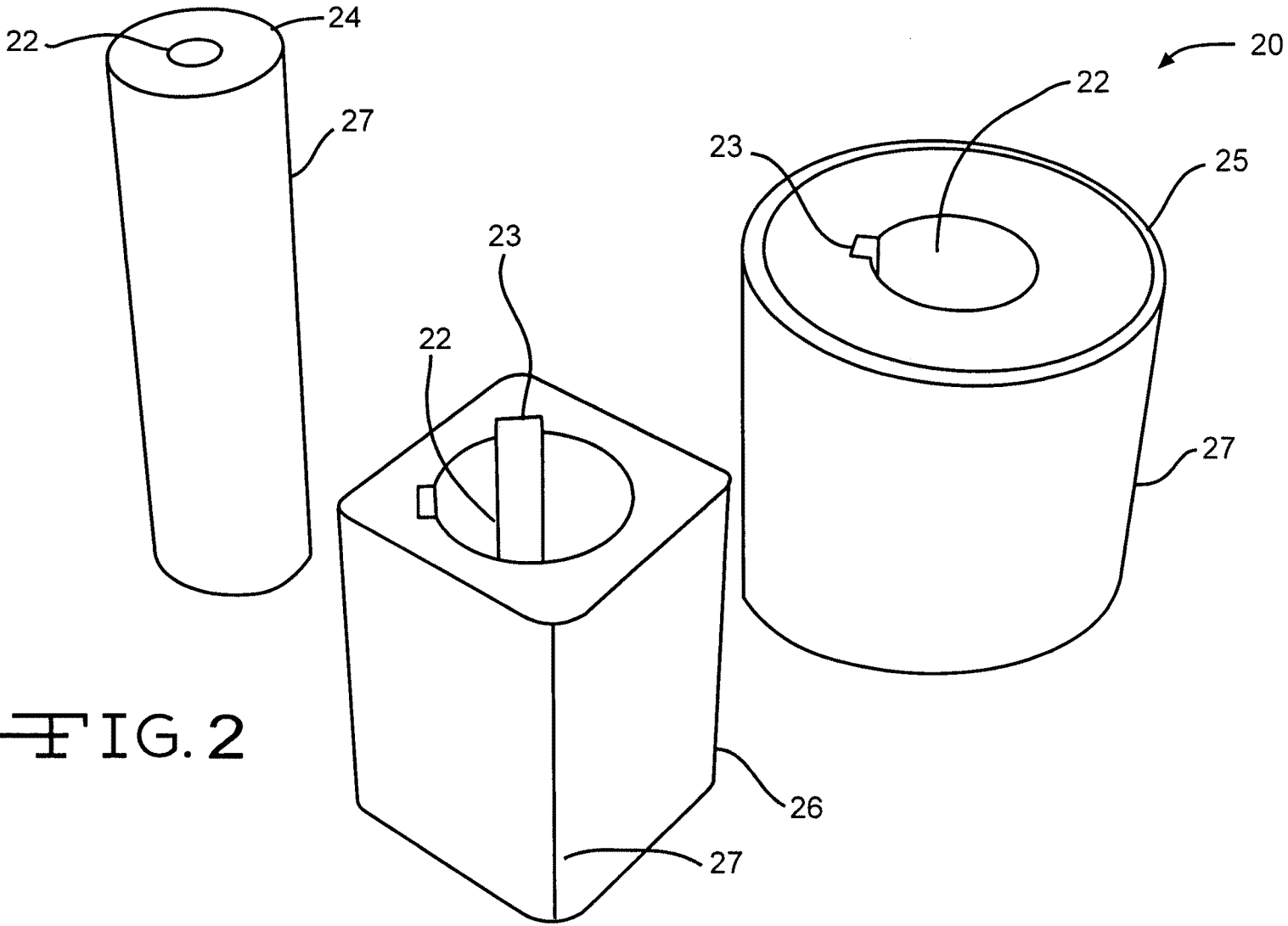
FIG. 2 illustrates exemplary tools over which the sheet metal specimens are pulled.

FIG. 2 illustrates exemplary sheet metal drawing tools 20 over which the sheet metal specimens 30 can be pulled. The tools 20 can be any shape desired to simulate actual production die sets and have interior gaps/bore holes 22 with keyways 23 for keys (not shown) to hold them in place on a shaft (not shown). FIG. 2 shows three typical tools 20 defining different typical geometries. The tools 20 generally define a cylindrical geometry having a central bore 22 for mounting in the SBDS apparatus. Tool 24 is relatively thin having a smaller diameter than tool 25. The surface 27 is generally rounded and the metal sheet 30 is drawn over the surface 27 and is therefore in contact with the same. Tool 25 is also generally cylindrical having a central bore 22 for mounting in a SBDS apparatus on a shaft. The height of the tool 25 is relatively shorter than the tool 24. However, the tool 25 has a substantially larger diameter. Accordingly, the tool 25 has a larger circumference than the tool 24 and thus a larger contact surface area with the metal sheet 30. Tool 26 has a generally rectangular shape, and it also defines a center bore 22 for mounting in a SBDS apparatus. The contact area with the metal sheet 30 is 90° and rounded.

Sheet metal specimens 30 that have been pulled through the exemplary SBDS apparatus have a generally curved/deformed shape as illustrated in FIG. 1. A sheet 30 that is pulled at or near its proximal/pulling end 30*a* and is secured at or near its distal/clamping end 30*b* results in a bend 34 in the sheet depending on the pulling angle θ. Each sheet 30 shows an indent 32 where it was clamped in the draw bead block set 40 and a bend 34 where it was in contact with the tool 20. Each sheet 30 may or may not have a surface distortion or skid line formed as a result of the simulation. Potential surface distortions or skid lines can occur at or near a position 36 generally between the proximal end 30*a* and the bend 34 (i.e., tool-sheet contact location) of the metal sheet 30. Force data can be measured for associated distortions.

FIGS. 3-6 illustrate various SBDS apparatus and systems according to the disclosure. A SBDS apparatus 100, 200 for approximating the die stamping of a metal generally includes (a) a fixed base 110, (b) a mounting plate 120, 220 mounted to the fixed base 110, (c) a sheet metal drawing tool 20 mounted to the mounting plate 120, 220, and (d) a draw bead block holder 10 mounted to the mounting plate 120, 220 and adapted to mount a draw bead block set 40 (e.g., a male draw bead block 42 and a corresponding female draw bead block 46). The fixed base 110 can include a generally horizontal support or base member 112 (e.g., for stably mounting the SBDS apparatus 100, 200 to a platform or other surface, such as a work surface of a tensile testing apparatus) and a generally vertical member 114 for attachment to the mounting plate 120, 220. The fixed base defines a longitudinal direction L (e.g., corresponding to the direction of extent for the vertical member 114) that generally corresponds to (e.g., parallel with) the pulling direction for a sheet metal strip 30 being pulled through the apparatus. The sheet metal drawing tool 20 can be fixedly mounted to the mounting plate 120, 220 (e.g., two separate structural units connected together or a single integrally formed structure having two functional components). Suitably, the tool 20 is removably mounted to the mounting plate 120, 220 (e.g., via a pin or bolt) to permit the mounting of variously shaped tools 20 for different SBDS simulation parameters. The various components of the SBDS are generally machined from a metal (e.g., steel) material, although any sturdy material capable of withstanding the induced forces and capable of maintaining the apparatus in a stable configuration during a sheet metal pulling process can be used.

The draw bead block holder 10 defines a back force direction B that corresponds to the direction of the induced back force B (shown in FIG. 1) resulting when a sheet metal strip 30 is clamped by the male 42 and female 46 draw bead blocks and pulled in the apparatus. In any of the various apparatus embodiments, the draw bead block holder 10 is positionable at a plurality of locations relative to the fixed base 110 so that an angle θ between the longitudinal direction L of the fixed base 110 and the back force direction B of the draw bead block holder 10 can be selected to have a plurality of values (e.g., continuously selectable between an upper and lower value or a plurality of discrete values between the same). The angle θ between the longitudinal direction and the back force direction is generally non-zero (e.g., where 0° represents a case where the longitudinal direction L and/or pulling direction P is parallel to the back force direction B), and it can span any desired range between its maximum and minimum extents (e.g., spanning 180°, 120°, 90°, 60°, 30°, or 15°). Alternatively or additionally, the apparatus can assume a configuration in which the angle θ is at least −90°, −60°, −45°, −30°, −15°, 0° and/or up to 15°, 30°, 45°, 60°, or 90°.

Figure 3A:
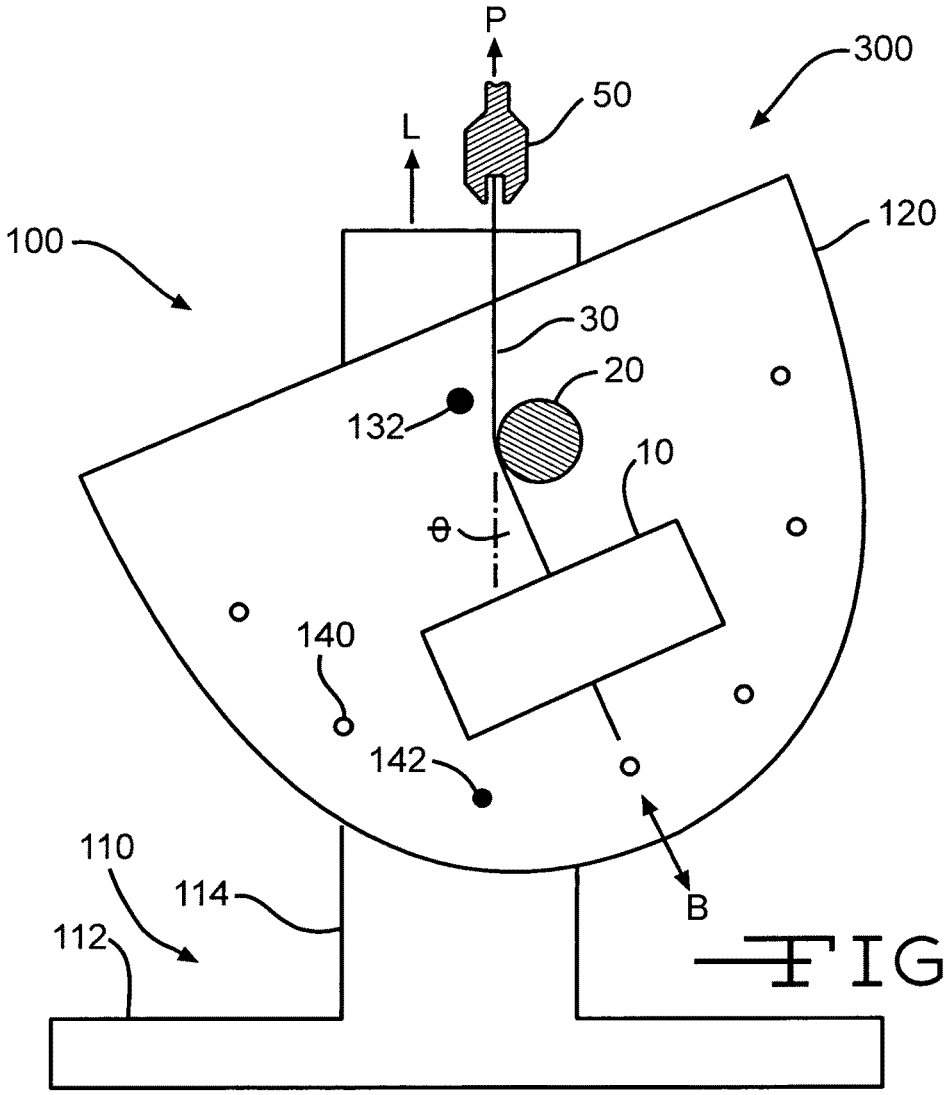
FIGS. 3A and 3B illustrate a front view (A) and a top view (B) of an embodiment of the SBDS according to the disclosure.
Figure 3B:
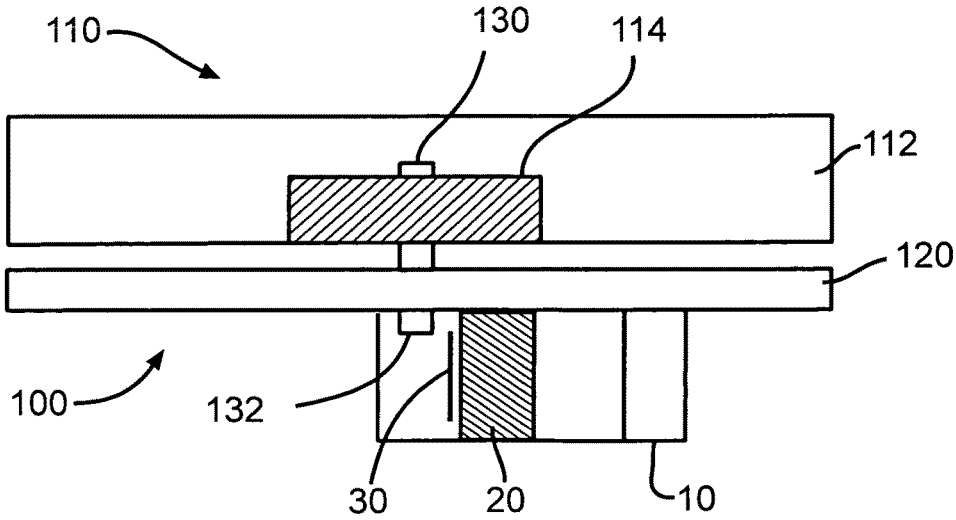

FIGS. 3A and 3B illustrate an embodiment of the SBDS apparatus 100 in which the mounting plate 120 is rotatably mounted to the fixed base 110 so that a rotation of the mounting plate 120 relative to the fixed base 110 defines the desired angle θ between the longitudinal direction L/pulling direction P and the back force direction B for a particular set of stretch-bend-draw simulation parameters. The means of rotatable connection between the fixed base 110 and 120 is not particularly limited, and can include a shaft or rod 130 mounted to an upper portion of the vertical base member 114 and the mounting plate at a rotation point 132 as illustrated. Once the mounting plate 120 is rotated to its desired angle, its position can be fixed in place relative to the base 110 by any convenient means to maintain the selected angle throughout a stretch-bend-draw simulation. For example, the mounting plate 120 can include a plurality of holes 140 (e.g., generally distributed in a semicircular arc around the rotation point 132) through which a fastening means 142 (e.g., a bolt, pin, or rod) can be placed and simultaneously mounted or fixed to the base 120 (e.g., the vertical member 114) to maintain the mounting plate 120 as well as its components (e.g., the draw bead block holder 10 and the drawing tool 20) at a fixed angular position relative to the base 110. As shown, the draw bead block holder 10 is fixedly mounted to the mounting plate 120 so that the relative position of the two apparatus components remains fixed. In another embodiment described in more detail with respect to FIG. 6, the mounting plate 120 can include one or more translation tracks two which the draw bead block holder 10 is translatably mounted so that the draw bead block holder 10 is translatable in the back force direction B to a plurality of positions on the mounting plate 120 (e.g., where any such translation does not change the angle θ).

Figure 4A:
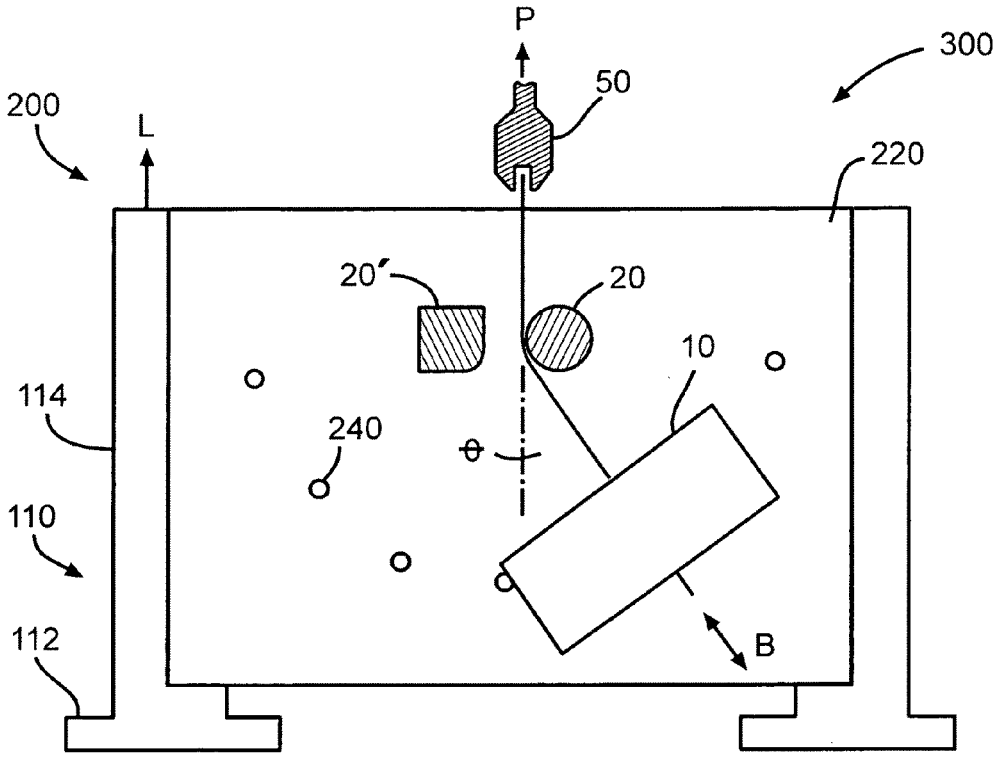
FIGS. 4A and 4B illustrate a front view (A) and a top view (B) of an alternate embodiment of the SBDS according to the disclosure.
Figure 4B:
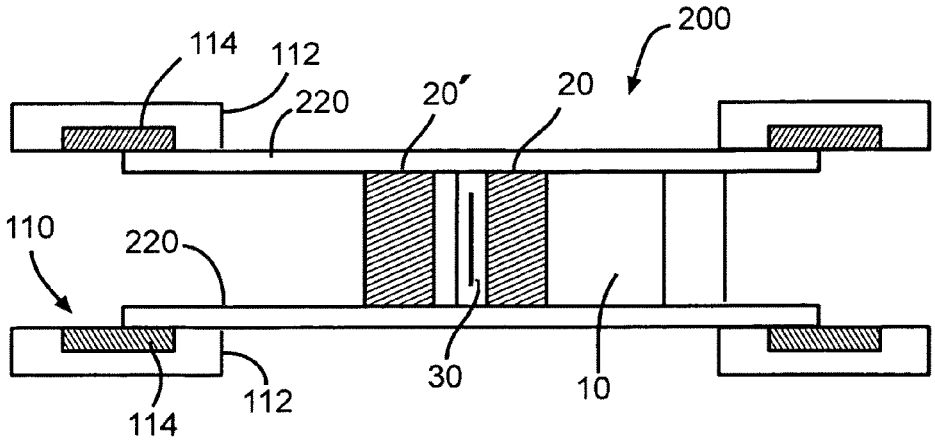

FIGS. 4A and 4B illustrate another embodiment of the SBDS apparatus 200 in which the mounting plate 220 is fixedly mounted to the fixed base 110. As illustrated, the mounting plate 220 is a separate structural unit mounted to the vertical member 114, although the two elements can be a single integrally formed structure having two functional components. FIG. 4A shows a front view of the apparatus 200 in which a single mounting plate 220 is mounted to two bases 110 and includes the draw bead block holder 10 and drawing tool 20 components. As shown in the top view of FIG. 4B, the apparatus 200 can include two opposing mounting plates 220 to which opposite sides of the drawing tool 20 and the draw bead block holder 10 are mounted, thereby providing more structural support for the apparatus components during a pulling simulation. The figures further illustrate an embodiment in which the mounting plate 220 includes two drawing tools 20, 20' mounted thereon on opposite sides of the pulling direction P (e.g., together defining a gap through which the sheet metal strip 30 is pulled during a simulation). Suitably, the tools 20, 20' have a different geometry such that the metal strip 30 is drawn over the tool 20 when the draw bead block holder 10 is mounted on one side of the mounting plate 220 (e.g., right side as illustrated) and the metal strip 30 is drawn over the tool 20' when the draw bead block holder 10 is mounted on the opposing side of the mounting plate 220 (e.g., left side as illustrated).

In the embodiment of FIGS. 4A and 4B, the draw bead block holder 10 is mountable in a plurality of positions so that the selection of a particular mounting position of the draw bead block holder 10 on the mounting plate 220 defines the desired angle θ between the longitudinal direction L/pulling direction P and the back force direction B for a particular set of stretch-bend-draw simulation parameters. The particular means for mounting or otherwise fixing the position of the draw bead block holder 10 on the mounting plate 220 is not particularly limited. The mounting plate 220 can include a mounting means 240 positioned along an arc (e.g., having a radius of curvature with a center near an upper position of the mounting plate 220 and/or near the tool 20) and adapted to mount the draw bead block holder 10 at a desired position to select the desired angle θ. As illustrated, the mounting means 240 can include a plurality of holes or slots 240 to accommodate a bolt or other fastening means that also mates with complementary structure such as holes or slots on the outer wall/surface of the draw bead block holder 10. In another embodiment (not shown), the mounting means 240 can include an arc-shaped slot/track through which pins or other protrusions from the outer wall of the draw bead block holder 10 can slide, thus permitting the draw bead block holder 10 to be continuously positionable at any desired location in the track (e.g., as compared with a discrete number of positions afforded by the illustrated holes 240).

Figure 5A:
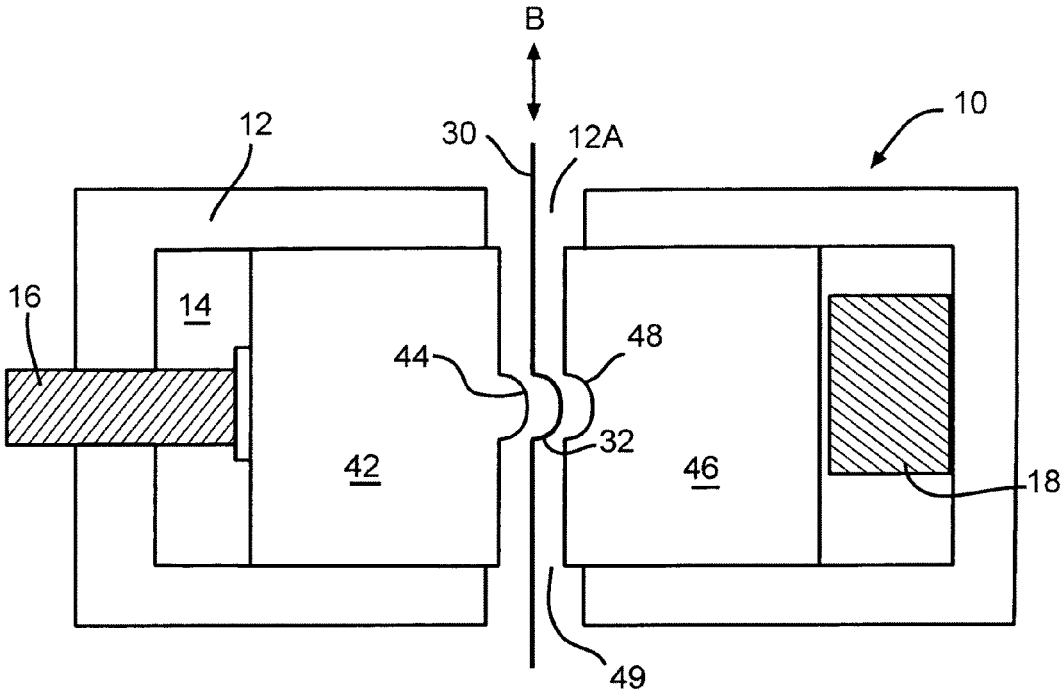
FIGS. 5A and 5B illustrate a side sectional view (A) and a top view (B) of a draw bead block holder according to the disclosure.
Figure 5B:
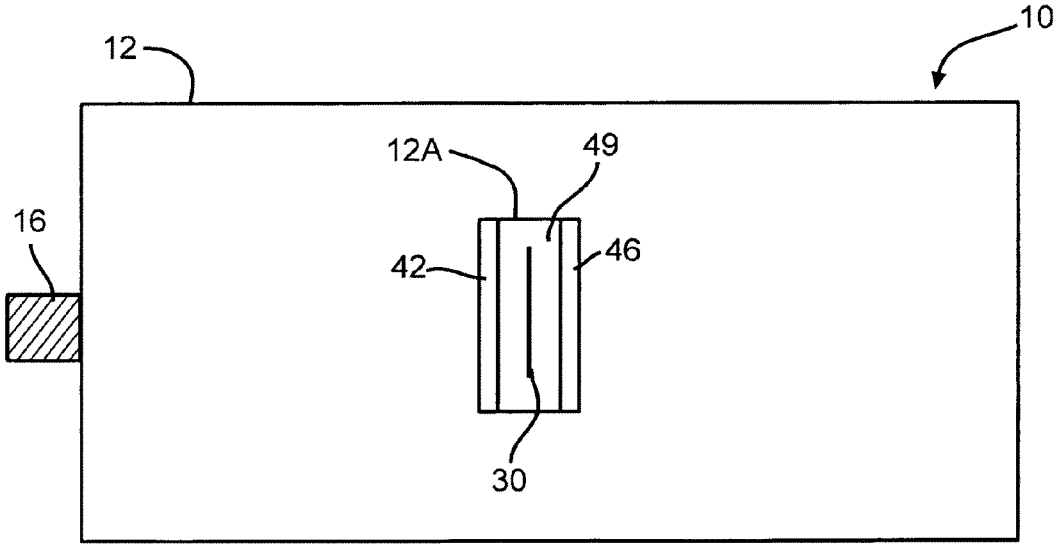

FIGS. 5A and 5B illustrate a side sectional view (A) and a top view (B) of a draw bead block holder 10 that can be used in any of the various apparatus embodiments. The holder 10 generally includes one or more wall 12 segments (e.g., multiple wall segments fastened together or a single integral component with multiple walls) that together define a cavity 14 sized and shaped to house the draw bead block set 40. The cavity suitably has a rectangular shape, but can have any desired shape corresponding to that of the male and female draw bead blocks 42, 46. The draw bead block holder 10 includes (e.g., housed within the cavity 14 or otherwise mounted/fixed to the holder 10) a compressing means 16 for compressing the male and female draw bead blocks 42, 46 together to clamp the sheet metal strip 30 therebetween during a stretch-bend-draw simulation, and a clamping force measuring means 18 for measuring the clamping force C resulting from the male and female draw bead blocks 42, 46 clamping on the sheet metal strip 30. Although not particularly limited, the compressing means 16 can be a threaded shaft (e.g., screw press), and the clamping force measuring means 18 can be a load cell.

The wall 12 of the block holder 10 generally includes an opening 12A through which the sheet metal strip 30 can pass from the block holder 10 exterior into the cavity 14 and between a gap or interface 49 between adjacent surfaces of the male and female draw bead blocks 42, 46. Suitably, the wall includes two openings 12A on opposing walls 12 of the block holder 10 such that the metal strip 30 can be threaded through the block holder 10. When housed in the block holder 10, the gap or interface 49 defines a direction (e.g., the path therethrough taken by the strip 30) that generally corresponds to the back force direction B. Although illustrated as a slit, the opening 12A can have any convenient shape that is sized to permit pass-through of the metal strip 30 but which provides sufficient structural support to retain the draw bead block set 40 fixedly positioned relative to the block holder 10 (e.g., within the cavity 14) during a stretch-bend-draw simulation.

The SBDS apparatus in any of its variously disclosed embodiments (e.g., the apparatus 100, 200 illustrated in the figures) can be incorporated more generally into a SBDS system 300 for approximating the die stamping of a metal. In addition to the apparatus with its attendant components, the system 300 includes a clamping and pulling means 50 for securing (e.g., clamping) one end of the sheet metal strip 30 and for pulling the sheet metal strip 30 across the sheet metal drawing tool surface 27 of the apparatus. The clamping and pulling means 50 has a pulling direction P that can define the longitudinal direction L of the fixed base 110. As illustrated, the pulling direction P is vertical (e.g., aligned or substantially aligned with gravity in use, such as within about 10° or 20° from the gravity direction), but the pulling direction P more generally can be any desired direction. For example, the longitudinal direction L and the pulling direction P can be substantially parallel (e.g., as illustrated in FIGS. 3A and 4A) or not. Suitably, the system 300 includes a pulling force measuring means for measuring a pulling force resulting from clamping and pulling the sheet metal strip 30 across the sheet metal drawing tool surface 27 of the apparatus. For example, the system can include a commercial tensile testing machine having an SBDS apparatus according to the disclosure mounted on a support/work surface of the machine (e.g., the fixed base 110 thereof mounted to the tensile testing machine work surface). Suitable commercial tensile testing machines are available from MTS Systems Corporation (Eden Prairie, Minn.; for example a Model 318.10 load frame equipped with a 100 kN transducer). In such case, the clamping and pulling means 50 of the system 300 can be a jaw grip of the tensile strength measuring machine and the pulling force measuring means can be a load cell of the tensile strength measuring machine (e.g., mounted in a housing on the tensile strength measuring machine to which housing the jaw grip is mounted). The system can further include a computer (not shown) for obtaining and recording force data, and the clamping force measuring means 18 and the pulling force measuring means are electronically coupled to the computer (e.g., wired, wireless) to transmit measured force data.

Figure 6:
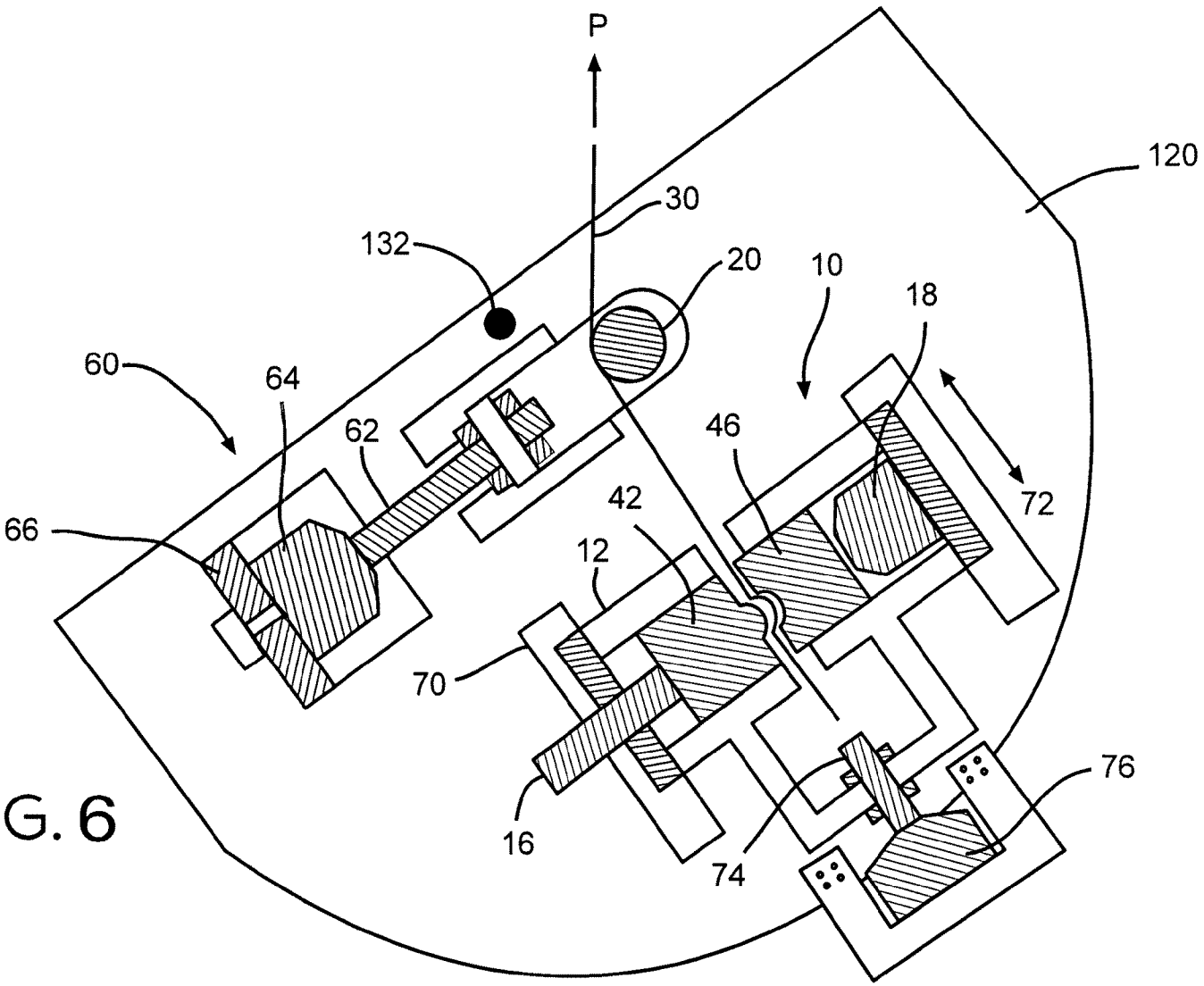
FIG. 6 illustrates a front view of an alternate embodiment of the SBDS according to the disclosure.

FIG. 6 illustrates an embodiment of the SBDS apparatus that is coupled to multiple means for measuring force data (e.g., load cells) associated with the metal sheet 30, including the pulling force P, the normal force N, the back force B, and the clamping force C. The sheet metal strip 30 is clamped into a jaw grip (not shown) coupled to a pulling force load cell for measuring the pulling force at the jaw grip. The pulling load cell is typically included on the tensile strength machine. The metal sheet 30 is aligned adjacent in contact with the tool 20. The tool 20 in FIG. 6 is shown with a rounded surface. The metal sheet 30 is slid through and subsequently clamped in the male and female draw bead blocks 42, 46. The tool 20 is positioned with respect to the rotation point 132 about which the mounting plate 120 rotates for providing unique angles θ to analyze the force data. The tool 20 can be translated by a shaft 62 which is typically threaded. The shaft 62 is coupled to a contact load cell 64 for measuring the contact normal force N resulting from the contact of tool 20 with metal sheet 30. The shaft 62 and load cell 64 are more generally part of a tool holding and moving means 60 that includes a base 66 to mount and support the shaft 62 and load cell 64. The tool holding and moving means 60 is generally rotatable as a unit, for example with the base 66 being rotatably mounted to the mounting plate 120 (e.g., at a position generally located behind the load cell 64; not shown). A wrap angle θ can be introduced by rotating the mounting plate 120 about the rotation point 132. The draw bead block holder 10 is mounted on the mounting plate 120 and thus rotates accordingly. As shown, the block holder 10 is mounted to the mounting plate 120 by tracks 70. The block holder 10 can slide freely along the tracks 70 and is positionable along a translation axis 72 defined by the tracks 70. Typically, the translation along the axis 72 can be achieved using a threaded shaft 74. The shaft 16, typically threaded, drives the draw bead blocks 42, 46 together, thus clamping the metal sheet 30. The clamping force C is measured using a clamping load cell 18. The back force B is measured by a back force load cell 76. Although the additional structure for measuring the back force B and the normal force N are illustrated in FIG. 6 as components of the apparatus embodiment shown in FIGS. 3A and 3B, analogous structural components can be included in the apparatus embodiment shown in FIGS. 4A and 4B (e.g., mounted on the mounting plate 220 thereof).

Figure 7:
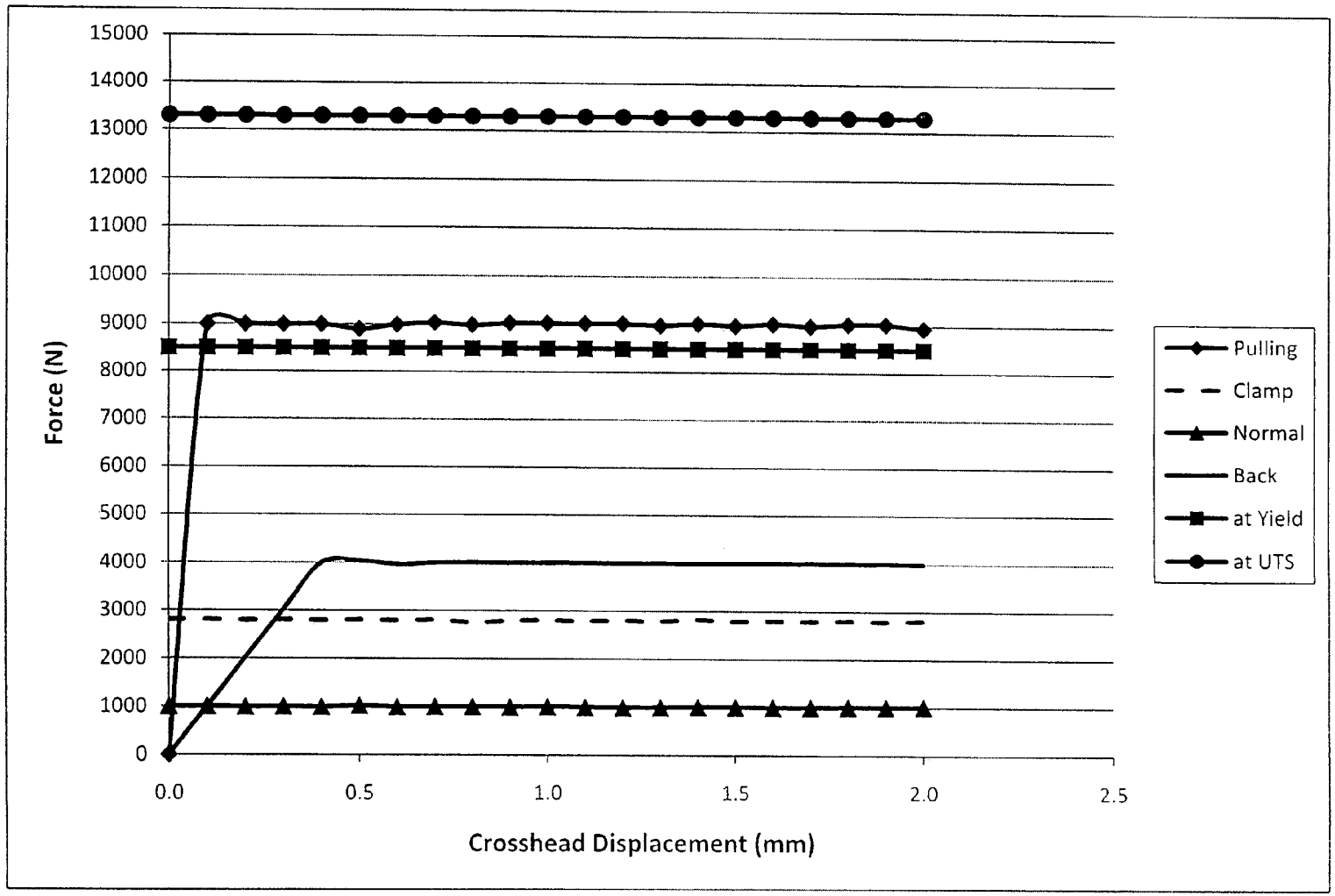
FIG. 7 is a graph of sample force data acquired using the SBDS.

FIG. 7 illustrates a graph of force data collecting using a SBDS apparatus of the present disclosure. Four force measurements are represented on the graph measured in Newtons (N; ranging from 0 N to 16000 N) as a function of crosshead displacement (mm; ranging from 0 mm to 2 mm). The pulling force P, clamping force C, normal force (i.e., contact force) N, and back force B are represented on the chart. In the graph, the stretching condition at which the specimen's shape is permanently changed ("Yield") is about 8400 N, and the stretching condition at which the loading capacity of the specimen is at its maximum ("UTS") is about 13300 N.

The SBDS apparatus and systems according to the disclosure can be used in a method for simulating and measuring stretch-bend-draw characteristics in a given experimental system, for example specified by parameters such as drawing tool shape and size, sheet metal type and thickness, draw angle. The male draw bead block 42 and the corresponding female draw bead block 46 are mounted within the draw bead block holder 10 so that the gap/interface 49 defines a direction corresponding to the back force direction B. The sheet metal strip 30 is then clamped into the draw bead block holder 10 between the male and female draw bead blocks 42, 46 at or near the distal end 30*b* of the sheet metal strip 30. The sheet metal strip 30 is contacted against the sheet metal drawing tool surface 27 at a point generally between the draw bead block holder 10 and the proximal end 30*a* of the sheet metal strip 30. The draw bead block holder 10 is then positioned at a location relative to the fixed base 110 to select a desired angle θ between the longitudinal direction L and the back force direction B. The longitudinal direction L and the back force B direction are generally different/non-parallel such that the angle θ is non-zero. The foregoing pre-simulation preparation steps generally can be performed in any desired order, after which the sheet metal strip 30 is pulled in the longitudinal direction L across the sheet metal drawing tool surface 27 from a point at or near the proximal end 30*a* of the sheet metal strip 30. The pulling of the sheet metal strip 30 can be performed by the securing proximal end 30*a* of the sheet metal strip 30 in the clamping and pulling means 50 (e.g., the jaw grip of the tensile tester) and then pulling the sheet metal strip 30 in the longitudinal direction L with the clamping and pulling means 50. Suitably, one or more of the pulling force P, the normal force N, the back force B, and the clamping force C are measured and (optionally) electronically communicated to a computer while pulling the sheet metal strip 30. Typically, a constant pulling speed is selected (e.g., for the tensile tester jaw grip or other pulling means 50) and the resulting forces are measured for a selected simulation (e.g., pulling) time. The pulling speed can be at least 20 mm/min, 50 mm/min, or 100 mm/min and/or up to 200 mm/min, 500 mm/min, 1000 mm/min, or 5000 mm/min, and the simulation/pulling time can be at least 1 sec, 2 sec, or 4 sec and/or up to 10 sec, 30 sec, or 60 sec. Once the pulling step of a simulation run is completed, the pulled sheet metal strip 30 can be examined (e.g., visual and/or tactile examination) for surface distortions resulting from the simulation, and the presence or absence of undesirable surface distortions can be correlated with any other simulation properties (e.g., measured force data profiles and/or specific geometric or physical properties).

The foregoing process for a single stretch-bend-draw simulation can be repeated for a variety of different operating conditions to identify parameters that reduce or eliminate the formation of surface distortions. For example, the process can be performed at two or more different angles θ between the longitudinal direction L and the back force direction D to identify an optimum angle or range of angles that reduces or eliminates surface distortions on the sheet metal strip 30 for a selected sheet metal strip 30 and sheet metal drawing tool 20. Additional parameters that can be varied for the determination of optimum drawing conditions can include tool 20 geometry and material selection, sheet metal strip 30 geometry and material selection, draw bead block set 40 bead/recess geometry and material selection, for example.

Because other modifications and changes varied to fit particular operating requirements and environments will be apparent to those skilled in the art, the disclosure is not considered limited to the examples chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

Throughout the specification, where the processes/methods or apparatus are described as including components, steps, or materials, it is contemplated that the compositions, processes/methods, or apparatus can also comprise, consist essentially of, or consist of, any combination of the disclosed components or materials, unless described otherwise. Numerical values and ranges can represent the value/range as stated or an approximate value/range (e.g., modified by the term "about").

What is claimed:

1. A stretch bend draw simulator apparatus for approximating die stamping of a metal, the apparatus comprising:

(a) a fixed base defining a longitudinal direction;

(b) a mounting plate mounted to the fixed base;

(c) a sheet metal drawing tool mounted to the mounting plate, the sheet metal drawing tool having a surface for contacting a sheet metal strip when the sheet metal strip is pulled across the sheet metal drawing tool surface to provide a pulling force measurement; and (d) a draw bead block holder mounted to the mounting plate and adapted to mount a male draw bead block and a corresponding female draw bead block, wherein:

(i) the draw bead block holder comprises (A) a compressing means for compressing the male and female draw bead blocks together to clamp the sheet metal strip therebetween when present, and (B) a clamping force measuring means for measuring a clamping force resulting from the male and female draw bead blocks clamping on the sheet metal strip when present;

(ii) the draw bead block holder defines a back force direction for the sheet metal strip being clamped by the male and female draw bead blocks when present; and (iii) the draw bead block holder is positionable at a plurality of locations relative to the fixed base so that an angle θ between the longitudinal direction of the fixed base and the back force direction of the draw bead block holder can be selected to have a plurality of values.

2. The apparatus of claim 1, wherein the mounting plate is rotatably mounted to the fixed base so that a rotation of the mounting plate relative to the fixed base defines a desired angle θ between the longitudinal direction and the back force direction.

3. The apparatus of claim 2, wherein the draw bead block holder is fixedly mounted to the mounting plate.

4. The apparatus of claim 2, wherein the mounting plate comprises one or more translation tracks and the draw bead block holder is translatably mounted on the translation tracks so that the draw bead block holder is translatable in the back force direction to a plurality of positions on the mounting plate.

5. The apparatus of claim 1, wherein (i) the mounting plate is fixedly mounted to the fixed base and (ii) the draw bead block holder is mountable in a plurality of positions on the mounting plate, each position defining a desired angle θ between the longitudinal direction and the back force direction.

6. The apparatus of claim 5, wherein the mounting plate comprises a mounting means positioned along an arc and adapted to mount the draw bead block holder at a desired position, thereby defining the desired angle θ between the longitudinal direction and the back force direction.

7. The apparatus of claim 1, wherein the angle θ between the longitudinal direction and the back force direction spans 180°.

8. The apparatus of claim 1, wherein (i) the compressing means of the draw bead block holder comprises a threaded shaft, and (ii) the clamping force measuring means of the draw bead block holder comprises a load cell.

9. The apparatus of claim 1, wherein the sheet metal drawing tool surface for contacting a sheet metal strip defines a cylindrical or rectangular surface.

10. The apparatus of claim 1, wherein the sheet metal drawing tool is fixedly mounted to the mounting plate.

11. The apparatus of claim 1, further comprising a male draw bead block and a corresponding female draw bead block housed within the draw bead block holder, wherein a gap or interface between adjacent surfaces of the male and female draw bead blocks defines a direction corresponding to the back force direction.

12. The apparatus of claim 1, further comprising a tool holding and moving means for removably mounting, translating, and positioning the tool with respect to the sheet metal strip;

wherein:

(i) the sheet metal drawing tool is mounted to the mounting plate via the tool holding and moving means for removably mounting, translating, and positioning the tool with respect to the sheet metal strip, (ii) the sheet metal drawing tool is removably mounted on the tool holding and moving means at a distal end and the tool holding and moving means is positionable from a proximal end, and (iii) the tool holding and moving means is coupled to a contact force measuring means for measuring the contact force on the sheet metal strip with the surface of the tool.

13. The apparatus of claim 12, wherein the holding and moving means is adapted to (i) translate the sheet metal drawing tool with respect to the sheet metal strip along a translation axis defined by the holding and moving means, and (ii) position the sheet metal drawing tool by moving the holding and moving means about a rotation axis.

14. The apparatus of claim 13, wherein the tool holding and moving means comprises a threaded shaft defining a longitudinal shaft axis, the threaded shaft being adapted to translate the tool along the longitudinal shaft axis.

15. The apparatus of claim 1, further comprising a base clamping means for mounting the sheet metal strip at an opposite end from the pulling end of the sheet metal strip, wherein the base clamping means is positioned adjacent the draw bead block holder and coupled to a back force measuring means for measuring a back force resulting from holding the sheet metal strip when pulling the sheet metal strip across the sheet metal drawing tool surface.

16. A stretch bend draw simulator system for approximating die stamping of a metal, the system comprising:

(a) the stretch bend draw simulator apparatus of claim 1;

(b) a clamping and pulling means for securing one end of a sheet metal strip and for pulling the sheet metal strip across the sheet metal drawing tool surface of the apparatus, the clamping and pulling means having a pulling direction that defines the longitudinal direction of the fixed base; and (c) optionally a pulling force measuring means for measuring a pulling force resulting from clamping and pulling the sheet metal strip across the sheet metal drawing tool surface of the apparatus.

17. The system of claim 16, wherein:

(i) the stretch bend draw simulator apparatus is mounted to a tensile strength measuring apparatus comprising a jaw grip and a load cell coupled to the jaw grip;

(ii) the clamping and pulling means of the system comprises the jaw grip of the tensile strength measuring apparatus; and (iii) the pulling force measuring means is present and comprises the load cell of the tensile strength measuring apparatus.

18. The system of claim 16, further comprising:

(d) a computer for obtaining and recording force data, wherein the clamping force measuring means and the pulling force measuring means are electronically coupled to the computer to transmit measured force data.

19. The system of claim 16, further comprising a male draw bead block and a corresponding female draw bead block, wherein a gap or interface between adjacent surfaces of the male and female draw bead blocks when both are housed within the draw bead block holder defines a direction corresponding to the back force direction.

20. The system of claim 16, wherein the stretch bend draw simulator apparatus is the apparatus of claim 2.

21. The system of claim 16, wherein the stretch bend draw simulator apparatus is the apparatus of claim 5.

22. A method for simulating and measuring stretch bend draw characteristics, the method comprising:

(a) providing the stretch bend draw simulator apparatus of claim 1;

(b) providing a male draw bead block and a corresponding female draw bead block housed within the draw bead block holder, wherein a gap or interface between adjacent surfaces of the male and female draw bead blocks defines a direction corresponding to the back force direction;

(c) providing a sheet metal strip having first and second opposed ends;

(d) clamping the sheet metal strip into the draw bead block holder between the male and female draw bead blocks at a position proximate the second end of the sheet metal strip;

(e) contacting the sheet metal strip against the sheet metal drawing tool surface at a point intermediate the first and second ends of the sheet metal strip;

(f) positioning the draw bead block holder at a location relative to the fixed base to select a desired angle θ between the longitudinal direction and the back force direction; and (g) pulling the sheet metal strip in the longitudinal direction across the sheet metal drawing tool surface of the apparatus from a point proximate the first end of the sheet metal strip.

23. The method of claim 22, further comprising:

(h) measuring and optionally electronically communicating to a computer at least one of (i) a clamping force resulting from the male and female draw bead blocks clamping on the sheet metal strip and (ii) a pulling force resulting from clamping and pulling the sheet metal strip across the sheet metal drawing tool surface of the apparatus while pulling the sheet metal strip.

24. The method of claim 22, further comprising:

(h) examining the pulled sheet metal strip for surface distortions resulting from the pulling of the across the sheet metal drawing tool surface.

25. The method of claim 22, wherein pulling the sheet metal strip in part (g) comprises securing the first end of the sheet metal strip in a clamping and pulling means and then pulling the sheet metal strip in the longitudinal direction with the clamping and pulling means.

26. The method of claim 22, wherein the sheet metal strip comprises a material selected from the group consisting of steel, aluminum, and aluminum alloys.

27. The method of claim 22, wherein the longitudinal direction and the back force direction are different.

28. The method of claim 22, further comprising repeating the method steps at two or more different angles θ between the longitudinal direction and the back force direction to identify an optimum angle or range of angles that reduces or eliminates surface distortions on the sheet metal strip for a selected sheet metal strip and sheet metal drawing tool.

29. The method of claim 22, wherein the stretch bend draw simulator apparatus is the apparatus of claim 2.

30. The method of claim 22, wherein the stretch bend draw simulator apparatus is the apparatus of claim 5.

* * * * *